US005504565A

United States Patent [19]

Tomiki et al.

[11] Patent Number: 5,504,565

[45] Date of Patent: Apr. 2, 1996

[54] IMAGE FORMING APPARATUS HAVING TRANSFER VOLTAGE TIMING CONTROL

[75] Inventors: Satoshi Tomiki, Kawasaki; Takeo Yamamoto, Yokohama, both of Japan

[73] Assignee: Canon Kabushiki Kaisha, Tokyo, Japan

[21] Appl. No.: 401,704

[22] Filed: Mar. 10, 1995

[30] Foreign Application Priority Data

Mar. 11, 1994 [JP] Japan ..... 6-041114
Mar. 3, 1995 [JP] Japan ..... 7-044185

[51] Int. Cl.[6] ..... G03G 15/16

[52] U.S. Cl. ..... 355/274; 355/271; 355/277; 355/309; 355/311

[58] Field of Search ..... 355/203, 208, 355/271, 273, 274, 277, 308, 309, 311

[56] References Cited

U.S. PATENT DOCUMENTS 4,958,194 9/1990 Kaieda et al. ..... 355/277
5,099,287 3/1992 Sato ..... 355/274
5,150,165 9/1992 Asai ..... 355/274
5,194,902 3/1993 Kamimura et al. ..... 355/277
5,253,022 10/1993 Takeuchi et al. .
5,438,399 8/1995 Asai ..... 355/273
5,455,664 10/1995 Ito et al. ..... 355/277

*Primary Examiner*—Sandra L. Brase
*Attorney, Agent, or Firm*—Fitzpatrick, Cella, Harper & Scinto

[57] ABSTRACT

An image forming apparatus includes an image bearing member for bearing a toner image; and a transferring member for forming a nip in cooperation with the image bearing member for transferring the toner image from the image bearing member to a recording material, in the nip, wherein a voltage having a polarity opposite from a polarity; normal toner is applied to the transferring member to transfer the toner image to the recording material; wherein the between start of the voltage application to the transferring member and the arrival of the leading end of the recording material at the nip is controlled on the basis of a type of the recording material.

25 Claims, 4 Drawing Sheets

IMAGE FORMING APPARATUS HAVING TRANSFER VOLTAGE TIMING CONTROL

FIELD OF THE INVENTION AND RELATED ART

The present invention relates to an image forming apparatus such as copying machines or laser beam printers, in particular, such image forming apparatuses that comprises a contact type transferring member, as a transferring member for transferring onto recording material a visible image (toner image) formed on an image bearing member, which charges the recording material by making contact therewith.

In a conventional electrophotographic image forming apparatus or electrostatic image forming apparatus, a transferring apparatus using the corona discharge (corona charger) is widely used as the transferring means for transferring onto the recording material such as paper a visible image (toner image) formed on image bearing material such as photosensitive or dielectric material.

The corona based transferring apparatus is effective as transferring means for transferring the toner image formed on the image bearing member onto the recording material by charging the recording material to a predetermined potential without making contact with the recording material. However, in order to discharge the corona, a substantially high voltage must be applied, which requires a high voltage power source. Also, there is such a problem as the ozone production during the corona discharge.

Therefore, image forming apparatuses of different type have been developed in recent years, which employ a contact-charge type transferring means that requires application of a relatively low voltage. Generally speaking, this contact-charge type transferring means comprises a charging member, such as an electrically conductive roller or brush, that makes contact with the backside of the recording material, wherein the toner image on the image bearing member is transferred onto the recording material by applying a relatively low transferring bias to this charging member. Because of this requirement for the low voltage application, the contact-charge type transferring means enjoys various advantages; for example, its power source can be reduced in size, weight, as well as cost, and also, the amount of the ozone production is small. As a result, it has been attracting a lot of attention.

FIG. 4 is a schematic side view of a conventional electrophotographic apparatus, in which a photosensitive drum 31 as the image bearing member and a transfer roller 32 as the transferring member are shown. After a toner image is formed on the photosensitive drum 31, the toner image is transferred onto a recording material P in a nip portion, which is formed as the transfer roller 32 presses on the photosensitive drum 21. During image transfer, a voltage having a polarity opposite to the toner image polarity is applied to the transfer roller 32 by a power source 33.

Generally speaking, the application of the transfer bias is started just before or right at the arrival of the recording material P at a transfer nip N, and is ended right at the moment the recording material P comes out of the transfer nip N or immediately thereafter.

Also generally speaking, during all of, or a portion or portions of: a period from the start of an image forming operation (start of copying operation) till the start of the transferring operation; a period from the end of one transfer operation to the start of next transferring operation; and a period from the end of the transfer operation to the end of the image forming operation (end of copying operation), a voltage having a predetermined level and a polarity opposite to the transfer bias polarity is applied to the transfer roller, so that the toner adhering to the transfer roll is caused to jump to the photosensitive drum to clean the transfer roller (hereinafter, cleaning bias).

However, the toner on the transfer roller cannot be completely removed by the cleaning bias. For example, during an image forming operation carried out immediately after a jam, which is caused as frequently used recording material gets stuck at a particular location due to a mechanical trouble or the like, is taken care of, the toner remaining on the transfer roller sometimes adheres to the backside of the recording material, soiling it (hereinafter, backside soiling). This backside soiling is more severe when a post card or a piece of card board is used as the recording medium than when a plain sheet of the standard size is used. More specifically, when an irregular sheet (special sheet), for example, a very small sheet of recording material such as a post card or business card, a sheet of thick recording material such as card board, or a sheet of electrically highly resistant recording material such as transparent resin sheet for an OHP is used as the recording material, the backside soiling is more often observed.

The dominant cause for the above described problems seems to be the following. When the toner image is transferred onto a special sheet, the transfer current of the recording material decreases in comparison with when the plain paper is used; therefore, it is easier for the residual toner remaining on the transfer roller, such as the insufficiently charged toner or the toner having been charged to a polarity opposite to the normally charged toner, to adhere to the backside of the transfer sheet.

As for means for eliminating this problem, it is conceivable to increase the transfer bias when the special sheet such as card board is used relative to when the plain sheet is used, so that a proper amount of the transfer current is secured. However, the solution is not that simple, since this method is tends to increase the drum damage on its off-sheet passage portion due to the increased transfer current.

On the other hand, a method such as disclosed in U.S. Pat. No. 5,253,022 has been known, in which the reversely charged toner is transferred from the transfer roller to the photosensitive drum before the toner image transferring operation. However, when this reverse toner cleaning is frequently carried out, it takes a longer time to form an image on the first transfer material; in other words, a longer time is required for the first copy.

SUMMARY OF THE INVENTION

Thus, a primary object of the present invention is to provide an image forming apparatus capable of preventing the backside soiling of the transfer material.

Another object of the present invention is to provide an image forming apparatus capable of preventing the backside soiling of the transfer material regardless of the transfer material type.

Another object of the present invention is to provide an image forming apparatus capable of preventing the toner charged to a polarity opposite to that of the normally charged toner from adhering to the backside of the transfer material.

Another object of the present invention is to provide an image forming apparatus capable of transferring the toner adhering to the transferring member to an image bearing member before the image transfer.

Another object of the present invention is to provide an image forming apparatus capable of reducing as much as possible the time required for forming the image on the transfer material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
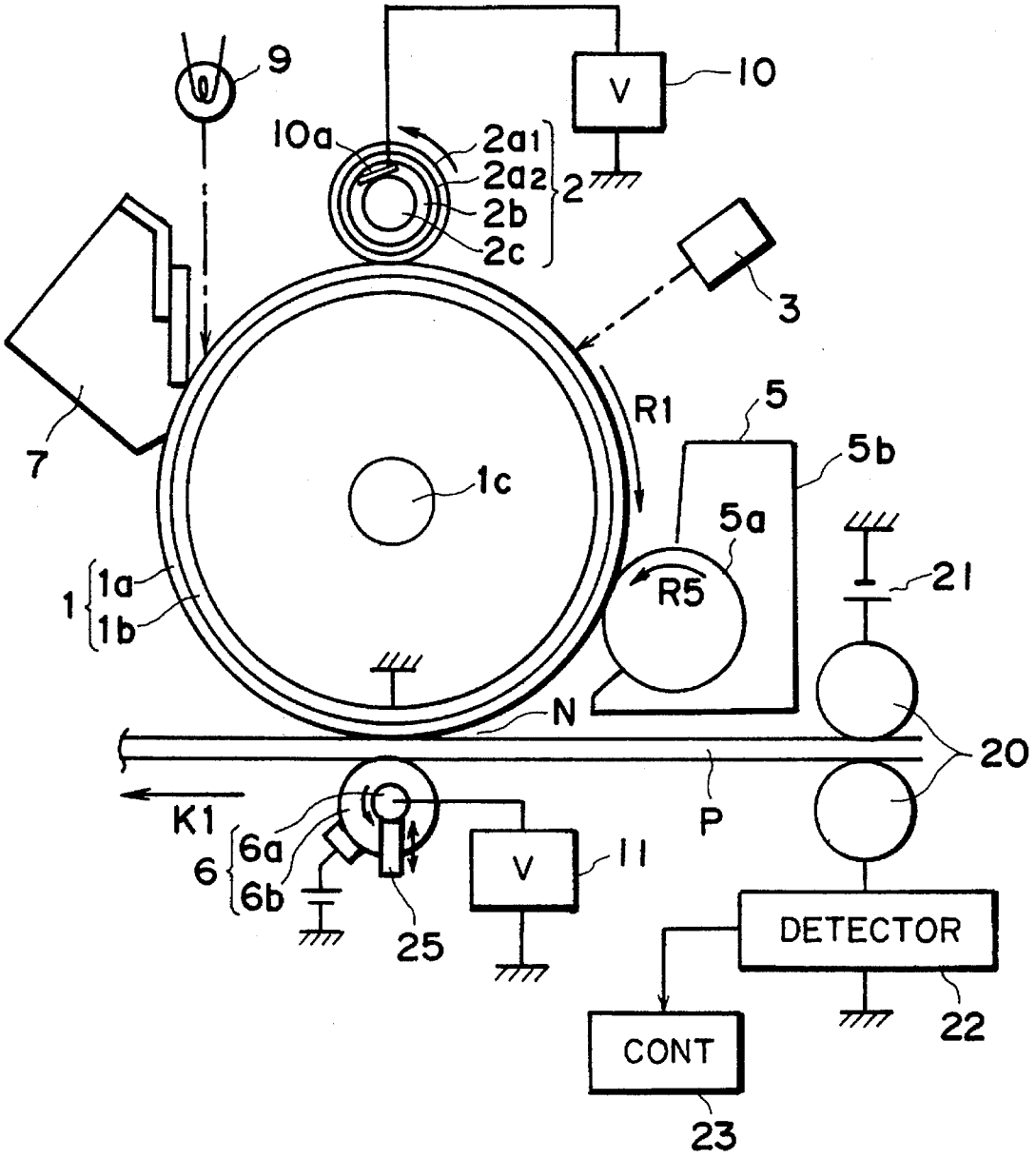
FIG. 1 is a schematic sectional view of an image forming apparatus in an embodiment of the present invention.

FIG. 1 is a schematic view of the adjacencies of the image bearing member in an image forming apparatus in accordance with the present invention. As will be described later in more detail, this image forming apparatus is an electrophotographic image forming apparatus, comprising a charging apparatus for charging the image bearing member and a transferring apparatus for transferring a toner image formed on the image bearing member to the recording material, wherein both apparatuses are of the contact-charge type.

More specifically, this image forming apparatus comprises a photosensitive drum 1 as the image bearing member, which is rotatively supported by an unillustrated main frame (hereinafter, "apparatus main frame") of the image forming apparatus. The photosensitive drum 1 is a cylindrical, electrophotographic photosensitive member, comprising basically an electrically conductive grounded base member 1*b* made of aluminum, iron or the like, and a photoconductive layer 1*a* of, for example, organic photoconductive material formed on the peripheral surface of the base member 1*b*. It also comprises a support axis 1*c* disposed at the center, and is rotatively driven about this support axis 1*c* by an unillustrated driving means in the direction of an arrow R1.

Above the photosensitive drum 1, a primary charging apparatus 2 is disposed. The primary charging apparatus 2 uniformly charges the surface of the photosensitive drum 1 to a predetermined potential level and polarity by coming in contact therewith, and its overall configuration is of a roller (hereinafter, "charge roller 2"). The charge roller 2 comprises a roller 2*c* made of electrically conductive material (metallic core), being disposed at the center, and an electrically conductive layer 2*b* formed on the peripheral surface thereof, and resistive layers 2*a*1 and 2*a*2 laminated on the peripheral surface of the layer 2*b*. It is rotatively supported in parallel to the photosensitive drum 1, with each end of the metallic core 2*c* being supported by an unillustrated bearing member 25, and is rotated in the direction of an arrow R2 by the rotation of the photosensitive drum 1 in the arrow R1 direction. The bearing member 25 is under a pressure generated by pressing means such as a spring to press it toward the photosensitive drum 1, whereby the resistive layer 2*a*1 at the surface of the charge roller 2 remains in contact with the photosensitive drum 1 surface, with a predetermined contact pressure. The metallic core 2*c* of the charge roller 2 is connected to an electrical contact 10*a* connected to a power source 10. In this embodiment, a DC bias voltage of −1300 V is applied to the charge roller 2 by the power source 10, whereby the photosensitive drum 1 surface is uniformly charged to −700 V.

On the downstream side of the charge roller 2 relative to the rotational direction of the photosensitive drum 1, an exposing means 3 is disposed. The exposing means 3 exposes the image on an original by the slit exposure, for example, and forms an electrostatic latent image on the photosensitive drum i surface in response to the image information obtained through this exposure. Incidentally, the exposing means 3 may be a laser scanner.

On the downstream side of the exposing means 3, a developing apparatus 5 is disposed. The developing apparatus 5 comprises a developer container 5*b* for storing the developer and a developing sleeve 5*a* for adhering the developer to the electrostatic latent image. The developer within the developer container 5*a* is coated on the developing sleeve 5*a* surface to a predetermined thickness as the developing sleeve 5*a* rotates in the direction of an arrow R5, being thereby carried to a developing station where the developing sleeve 5*a* directly faces the photosensitive drum 1. In the developing station, the toner is transferred from the developing sleeve 5*a* to the photosensitive drum 1 and is adhered to the electrostatic latent image on the photosensitive drum 1. As a result, the electrostatic latent image is turned into a visible image (toner image) by the adhesion of the toner. At this time, the toner has been charged to a predetermined polarity, and in this embodiment, the toner is charged to the positive (normal) polarity.

Below the photosensitive drum 1, a roller-shaped transferring apparatus 6 (hereinafter, "transfer roller 6") is disposed on the downstream side of the developing apparatus 5. The transfer roller 6 comprises a roller (metallic core) 6*a* of electrically conductive material connected to a power source 11, and an electrically conductive cylindrical layer 6*b* formed on the peripheral surface thereof. It is rotatively supported in parallel to the photosensitive drum 1, with each end of the metallic core 6*a* being supported by a bearing member 25, and is rotated in the direction of an arrow R6. This bearing member 25 is under a pressure generated by a pressing member such as a spring for pressing the transfer roller 6 toward the photosensitive drum 1, whereby the conductive layer 6*b* of the transfer roller 6 remains in contact with the photosensitive drum 1 surface maintaining a predetermined contact pressure; therefore, a transfer nip N is formed between the photosensitive drum 1 and transfer roller 6. In the transfer nip N, a recording material P, being conveyed in the direction of an arrow K1 by an unillustrated sheet feeding mechanism, is delivered in synchronism with the rotation of the photosensitive drum 1. While the recording material P is pinched, and thereby conveyed forward, by the transfer nip N, it makes contact with the photosensitive drum 1 by its front surface and the transfer roller 6 by the backside surface. During its passage through the nip N, a bias voltage having a polarity opposite to the toner polarity is applied to the back surface of the recording material P by the power source 11, charging directly the back surface of the recording material P to the polarity opposite to the toner polarity. As a result, the toner image on the photosensitive drum 1 is transferred onto the front surface of the recording material P. As for means for driving charge roller 2 and transfer roller 6, they may be driven using gears attached to the metallic cores 2*c* and 6*a* and a driving means such as a motor connected to the gears.

The recording material P having gone through the toner image transfer is separated from the photosensitive drum 1 and is delivered to an unillustrated image fixing means, where the toner image is fixed to the recording material P. Then, the recording material P is discharged as a finished copy from the main frame. When the images are transferred in multi-layer onto the recording material P, or are transferred onto both surfaces of the recording material P, the recording material P is recirculated by recirculating means through the image forming portion comprising the photosensitive drum 1 and other components.

After the image transfer, the unwanted substance such as residual toner adhering to the photosensitive drum 1 is removed by a cleaner 7, and then, the photosensitive drum 1 is discharged by a discharged apparatus 9 to prepare it for the next image forming process.

As for the material for the conductive layer 6*b* of the transfer roller 6, formed EPDM (ethylene-propylene-diene monomer), SBR (styrene-butadiene rubber), BR (butadiene rubber), or the like containing either independent cells or continuous cells is used, wherein its resistance value is in a range of $10^7$–$10^{10}$ ohm/cm; the diameter, 20 mm; and the length in the axial direction is 300 mm.

Further, in order to prevent or reduce the backside soiling of the recording material P that occurs during the image transfer, the following measures are taken; the transfer bias applied to the transfer roller 6 (constant voltage having a polarity opposite to the toner charge polarity during the image development) is placed under the constant voltage control correspondent to the thickness d of the recording material P, and a time t between the start of the bias voltage application and the arrival of the recording material P at the transfer nip N, that is, the length of a period in which the voltage having the polarity opposite to the toner polarity is applied to the transfer roller 6 before the recording material P reaches the transfer nip N, is varied.

On the upstream side of the transfer nip N relative to the recording material P conveyance direction (arrow K1 direction), a thickness detecting means is disposed, which comprises a pair of register roller 20, a DC power source 21, a measuring device 22, and the like. All needed to detect the thickness of the recording material using the thickness detecting means is to detect the current flowing through the recording material while a voltage is applied between the roller pair. In addition, the each end of the metallic core 6*a* of the transfer roller 6 is rotatively supported by the bearing member 25, and each bearing member 25 is under the pressure generated by the pressing member such a spring for pressing the bearing member 25 toward the photosensitive drum 1 surface as described before; therefore, the conductive layer 6*b* of the transfer roller 6 remains in contact with the photosensitive drum 1 surface maintaining a predetermined level of contact pressure.

Further, the recording material delivery timing of the register roller 20 is controlled by a control circuit 23 in response to the data obtained by the thickness detecting means, whereby the time t between the start of the transfer bias application and the arrival of the recording material P at the transfer nip N is varied. For example, the thickness d of the recording material P is thick, the time t between the start of the transfer bias application and the arrival of the recording material P at the transfer nip N is extended, and on the contrary, when the thickness d of the recording material P is thin, the time t is shortened. It should be noted here that the timing with which the electrostatic image formation on the photosensitive drum 1 in accordance with the imaging data is started is also controlled in coordination with this recording material delivery timing.

Figure 2:
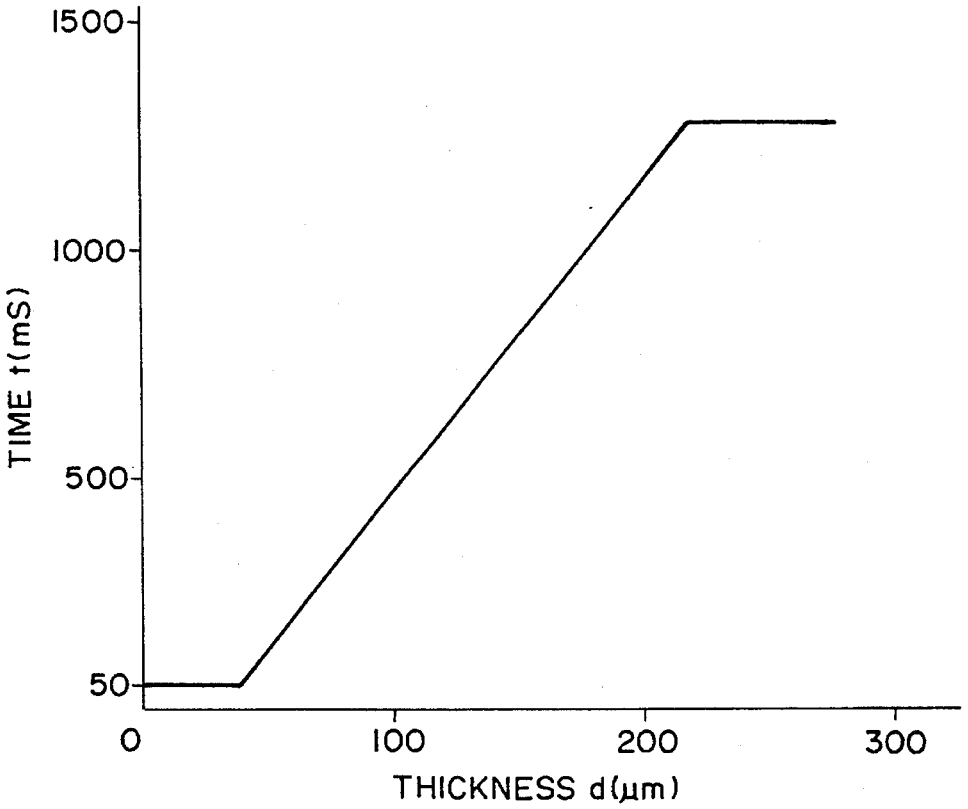
FIG. 2 is a graph showing the relationship between the time when the transfer bias application begins and the time when the recording material arrives at the transfer nip.

FIG. 2 is a graph showing the relation among the thickness d of the recording material P, the time t between the start of the optimum transfer bias application and the arrival of the recording material P at the transfer nip N.

In this embodiment, the image forming speed of the image-forming apparatus is 100 mm/sec.

These data are stored in advance in a memory, and the time t between the start of the transfer bias application and the arrival of the recording material P at the transfer nip N is varied in response to the thickness d of the recording material P detected by the measuring device 22, whereby preferable images with no soiling can be formed even when a recording material P such as a sheet of card board having a thick thickness d is used. More specifically, even when a sheet of card board is used as the recording material, the reversely charged toner can be satisfactorily transferred from the transfer roller to the photosensitive drum by extending the time t. On the other hand, when plain thin paper is used as the recording material, it is not likely to be soiled; therefore, the time t may be shortened to reduce the time required for the image formation thereon (first copy time).

In this embodiment, the time t is adjusted on the basis of the recording material thickness, but it may be varied on the basis of the recording material size and the resistance value data (data obtained by placing a temperature sensor and a humidity sensor in the apparatus).

Also in this embodiment, the detecting means for obtaining the aforementioned data is disposed within the image forming apparatus, but the data may be externally inputted from a computer, word processor, or the like. Further, the time t may be charged on the basis of the input such as recording material thickness, size, resistance value, and the like, which are selected by a user through the control panel.

Shown below is a case in which the transfer material type is externally inputted by the user through the control panel of the image forming apparatus illustrated in FIG. 1. In this case, the user can select between a plain sheet mode and a special sheet mode by inputting externally the transfer material type into the apparatus. The plain paper mode is for using the plain paper as the transfer material, and the special sheet mode is for using a post card, transparent resin sheet for an OHP, or card board, as the transfer material.

Figure 5:
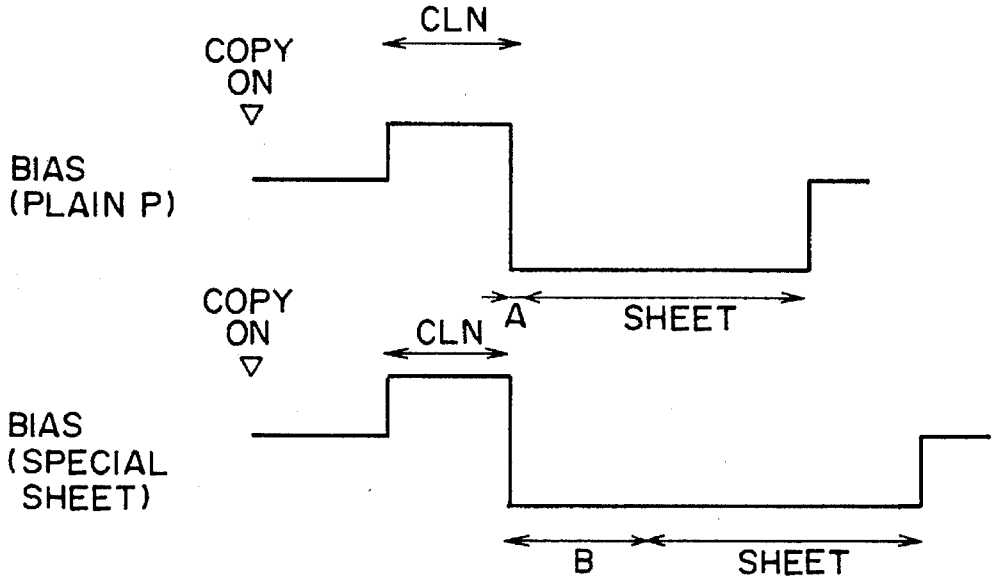
FIG. 5 is a timing chart showing the bias application timing for the transfer roller with reference to a plain paper mode and a special sheet mode.

FIG. 5 is a transfer bias application time chart for the transfer roller with reference to the plain sheet and special sheet modes.

When the plain sheet mode is selected, the normal toner adhering to the transfer roller 6 is cleaned as an electric field, in which the normal toner (positively charged toner) is transferred from the transfer roller 6 to photosensitive drum 1, is formed a predetermined length of time after a copy button is depressed. At this time, a current of +10 μmA (cleaning bias being in a range of +2.5 KV to +3.0 KV) is supplied to the transfer roller 6 to enhance the cleaning operation. After the cleaning bias is applied to the transfer roller 6 for a duration equivalent to two full rotations of the transfer roller 6, the voltage applied to the transfer roller 6 is switched to the negative side for the transfer operation, during which a voltage in a range of −3.5 KV to −4.0 KV is applied to the transfer roller 6 (transfer roller 6 is placed under the constant voltage control). A time A after the start of the application of the negative voltage to the transfer roller 6, the leading end of the recording material P reaches the transfer nip N. While the recording material P is passing through the nip N, the toner image is transferred from the photosensitive drum 1 to the recording material P. The time A is necessary for the voltage of the power source 11 to rise and stabilize, and its duration is substantially equivalent to one half of a full rotation of the transfer roller 6. In the plain sheet mode, it is unlikely for the backside of the recording material be soiled even when the reversely charged toner is adhering to the transfer roller; therefore, it is not essential to return the reversely charged toner adhering to the transfer drum to the photosensitive drum; in other words, the time A can be substantially shortened. As a result, the time (first copy time) between the pressing of the copy button and the completion of the image formation can be shortened. Further, the transfer roller does not unnecessarily charge the photosensitive drum; therefore, the damage to the photosensitive drum is reduced.

When the special sheet mode is selected, the same electric field as the one formed in the plain sheet mode, in which the normal toner is transferred from the transfer roller to photosensitive drum is formed a predetermined length of time after the copy button is pressed. The time between the pressing of the copy button and the start of the cleaning bias application to the transfer roller 6, and the duration of the cleaning bias application to the transfer roller 6 (equivalent to full two rotations of the transfer roller) remain the same whichever mode is selected, the plain sheet mode or special sheet mode. After the cleaning bias application to the transfer roller 6, the voltage applied to the transfer roller 6 is switched to the negative side for the image transfer. During the image transfer, the transfer roller 6 is placed under the constant voltage control at a voltage in a range of −3.5 KV to −4.0 KV. A time B after the start of the application of the negative voltage to the transfer roller 6, the leading end of the recording material P reaches the transfer nip N, and while the recording material P is passing through the nip N, the toner image is transferred from the photosensitive drum to the recording material. For the duration of the time B, an electric field, which functions to transfer to the photosensitive drum 1 the reversely charged toner (negatively charged toner) adhering to the transfer roller 6, is formed. The time B is longer than the time A, and its duration is equivalent to two full turns of the transfer roller. In the special sheet mode, the backside of the recording material is liable to be soiled if the reversely charged toner is adhering to the transfer roller; therefore, the backside soiling of the recording material can be prevented by returning to the photosensitive drum 1 the reversely charged toner adhering to the transfer roller for the duration of the time B.

Here, it should be noted that the apparatus is designed so that the recording material delivery timing of the register roller 20 pair and the duration of the voltage application to the transfer roller 6 by the power source 11 are controlled by the control circuit in response to the sheet mode selection.

Further, referring to FIG. 5, during the cleaning bias application to the transfer roller, the time A and the time B, the surface potential of the photosensitive drum is set at −300 V.

Embodiment 2

In the second embodiment, a thickness detecting means and a size detecting means are placed in the same image forming apparatus as the one used in the first embodiment, and the recording material P delivery timing is controlled on the basis of two types of information to vary the time t between the start of the transfer bias application and the arrival of the recording material P at the transfer nip N.

Figure 3:
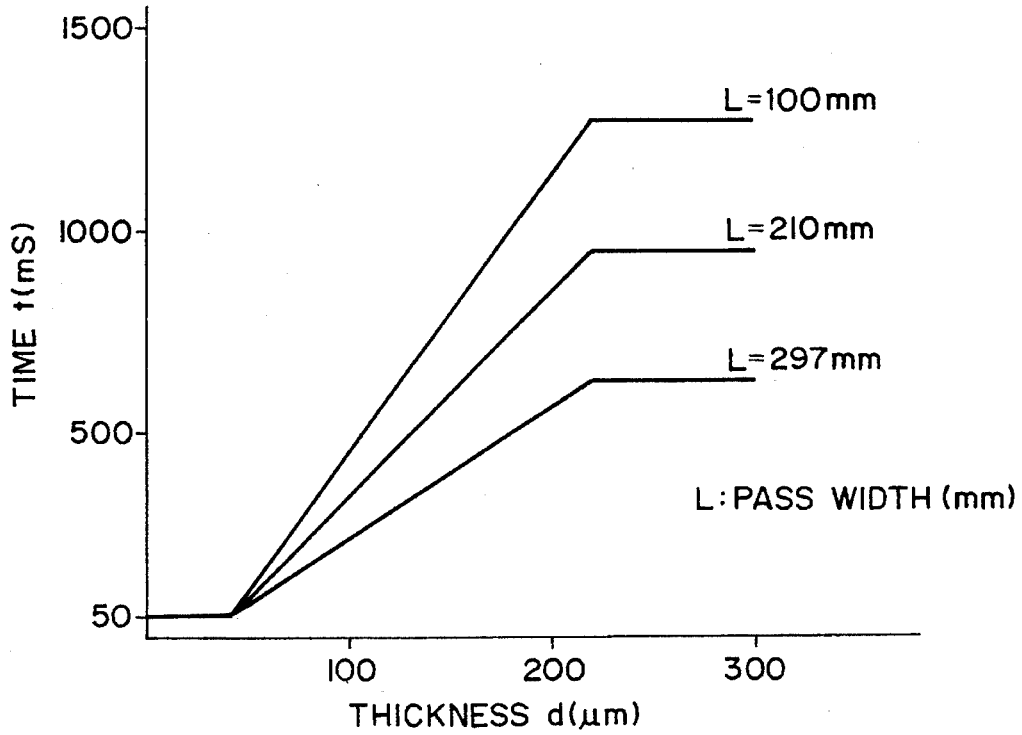
FIG. 3 is a graph showing the relationship among the recording material thickness, recording material size, and a duration of the transfer bias application during a non-image forming method.
Figure 4:
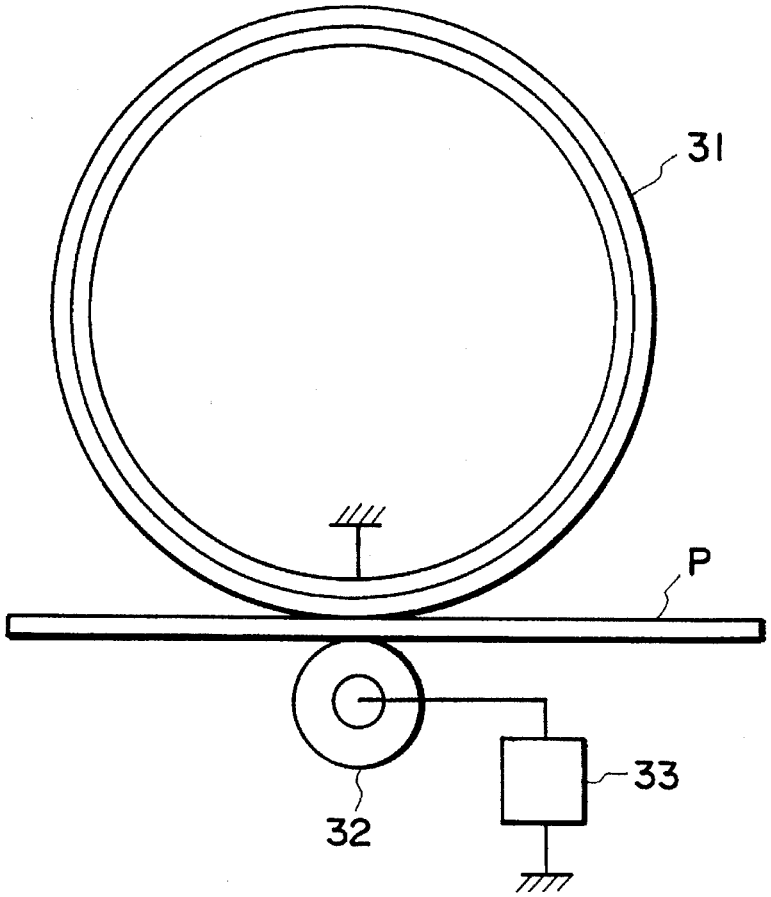
FIG. 4 is a schematic sectional view of the image transferring portion of a conventional image forming apparatus.

FIG. 3 is a graph showing the relationship among the recording material P thickness d, size (foot print width) L thereof, and the time t between the start of the optimum transfer bias application and the arrival of the recording material P at the transfer nip N.

In FIG. 3, the results for recording materials of three different size in size L (in the direction of the drum sheet 1*c*, that is, in the direction perpendicular to the page of FIG. 1) are plotted: 100 mm (equivalent to the length of a post card); 210 mm (equivalent to the length of A4 sheet); and 297 mm (equivalent to the length of A3 sheet).

When the toner image is transferred onto a recording material of a small size (foot print width), for example, a post card or the like, the photosensitive drum 1 and transfer roller 6 make direct contact with each other, and as a result, the current that flows through the recording material is reduced, which is liable to cause the backside soiling of the recording material.

This embodiment prevents this type of backside soiling, and also, prevents the drum damage caused by the excessive duration of the time t when the normal size recording material such as an A3 size recording material, or a sheet of thin paper is used. In addition, this embodiment can shorten the first copy time.

In this embodiment, the time t is adjusted on the basis of the information regarding the thickness and size (foot print width) of the recording material. In this case, the information about the resistance value of the recording material may be used in place of the thickness and size information or may be used in conjunction with them to vary the time t.

Embodiment 3

In the third embodiment, when a specific one is selected among a plurality of the recording material feeding means in an image forming apparatus, the time t between the start of the transfer bias application and the arrival of the recording material P at the transfer nip N is switched.

Figure 6:
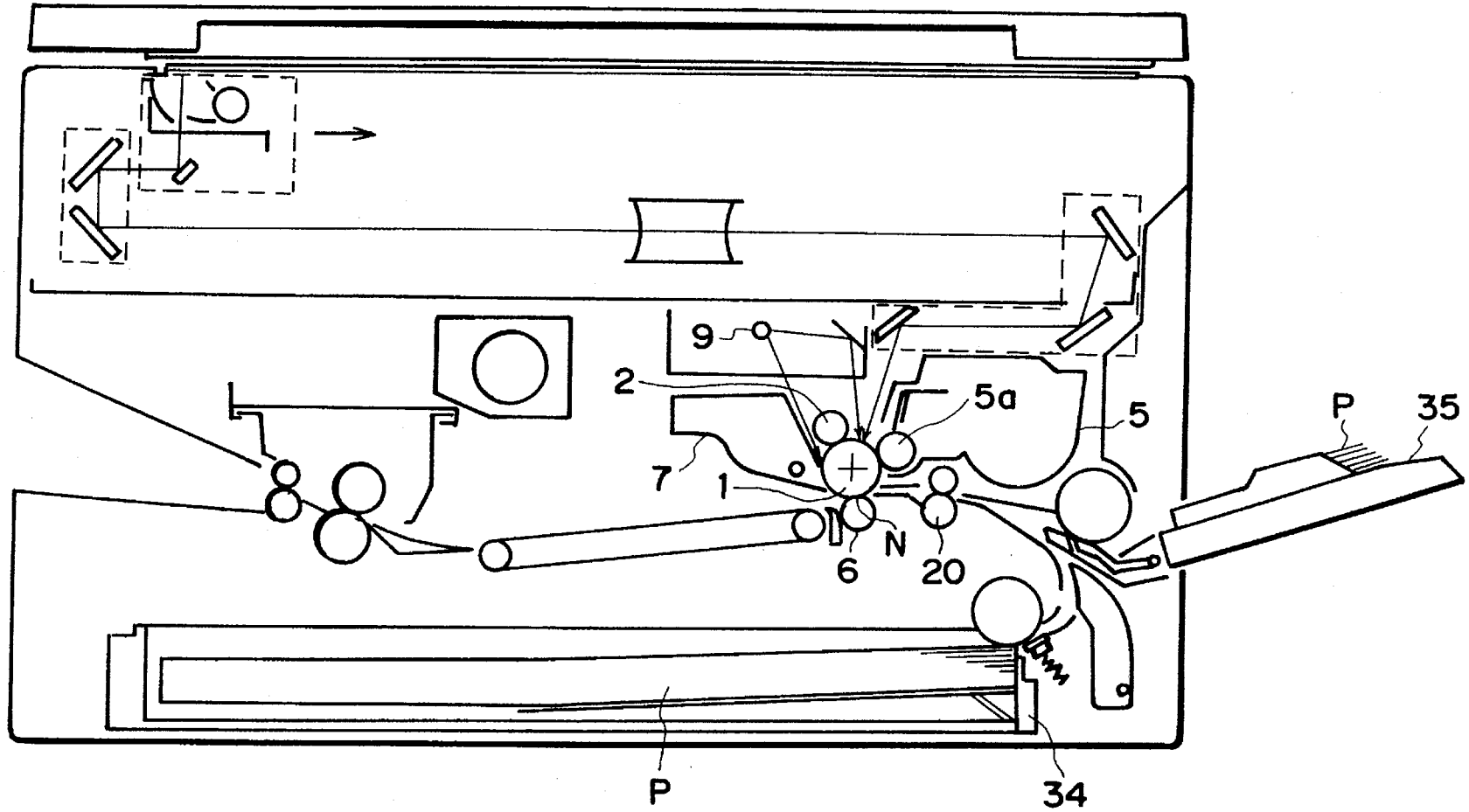
FIG. 6 is a sectional view of an image forming apparatus comprising a sheet feeder cassette and a manual sheet feeder tray.

In this embodiment, the same image forming apparatus as the on used in the first embodiment is used. The image forming apparatus in this embodiment employs a so-called cassette feeding system as shown in FIG. 6, wherein the recording material P is held in a dedicated cassette 34. The image forming apparatus comprises cassette based feeding means for delivering the recording material from the cassette 34 to the transfer nip N during the image formation, and a manual feeding means for delivering the recording material from a manual feeding tray where the user manually places the recording material. The manual feeding means is used when the post card or sheet of card board is used as the recording material. When the manual feeding means is selected by the user through the control panel or the like, the time t between the start of the transfer bias application and the arrival of the recording material P at the transfer nip N is automatically changed.

In this embodiment, when the cassette 34 based recording material feeding means is used, the time t is reduced to 50 msec, and when the manual feeding means is in use, the time t is increased to 630 msec (equivalent to approximately one full rotation of the transfer roller).

In this embodiment, when the special sheet such as a post card, sheet of card board, OHP sheet, or the like is used as the recording material, the manual feeding means is employed. With this arrangement, the backside soiling of the recording material during the image forming operation can be satisfactorily prevented with low cost. Further, since the cassette based feeding means is used when the plain sheets are used, the first copy time is shortened, and at the same time, the drum damage can be reduced.

Further, the recording material size detecting means and/or resistance value detecting means may be added to the image forming apparatus of this embodiment to use the obtained information for the apparatus control.

Further, when the manual feeding means is used in this embodiment, the duration of the time t is set to a length equivalent to approximately one full turn of the transfer roller, but the time t is preferable to be longer than one full turn.

Further, when the manual feeding means is used, the timing sequence for the special sheet mode shown in FIG. 5 may be adopted, and when the cassette based feeding means is used, the timing sequence for the plain sheet mode shown in FIG. 5 may be adopted.

With the provision of the aforementioned arrangement, when the small recording material, thick recording material, or recording material with a high resistance value is used as the recording medium and is fed through a special recording material feeding means such a manual feeding means, the time between the start of the transfer bias application by the transferring apparatus and the arrival of the leading end of the recording material P at the transfer nip N can be extended compared to when the plain sheets are fed using the cassette; therefore, the reversely charged toner or the like is caused to jump to the photosensitive drum to clean the transfer roller, or the insufficiently charged toner or the like remains satisfactorily attracted to the transfer roller, so that the backside soiling of the recording material can be prevented or sufficiently reduced.

As described above, according to the present invention, the backside soiling of the recording material can be prevented by adjusting, on the basis of the recording material type, the duration of the voltage application to the transferring member before the arrival of the recording material at the transfer station.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image; and a transferring member for forming a nip in cooperation with said image bearing member for transferring the toner image from said image bearing member to a recording material, in the nip, wherein a voltage having a polarity opposite from a polarity of normal toner is applied to said transferring member to transfer the toner image to the recording material;

wherein time between start of the voltage application to said transferring member and the arrival of the leading end of the recording material at the nip is controlled on the basis of a type of the recording material.

2. An image forming apparatus according to claim 1, wherein the time is before the arrival of the leading end of the recording material at the nip, regardless of the recording material type.

3. An image forming apparatus according to claim 2, wherein when a special type of sheet is used as the recording material, time between the voltage application starting and the arrival of the leading end of the recording material at the nip is longer than when the plain sheet is used.

4. An image forming apparatus according to claims 2 or 3, wherein said transferring member is a rotary member, and when the special sheet is used, the time between the voltage application starting and the arrival of the leading end of the recording material at the nip is equivalent to at least one full turn of said transferring member.

5. An image forming apparatus according to claim 4, wherein when the plain sheet is used as the recording material, the time between the voltage application starting and the arrival of the leading end of the recording material at the nip is shorter than one full turn of said transferring member.

6. An image forming apparatus according to claim 3, wherein the special type of sheet is a post card.

7. An image forming apparatus according to claim 3, wherein the special type of sheet is a sheet of transparent resin material.

8. An image forming apparatus according to claim 2, wherein said transferring member is a rotary member, and the time between the voltage application starting and the arrival of the leading end of the recording material at the nip is either equivalent to at least one full turn of the said transferring member or shorter than one full turn of said transferring member in response to the recording material type.

9. An image forming apparatus according to claim 2, wherein an electric field, which functions to transfer the toner having the same charge polarity as the toner image polarity from said transferring member to image bearing member, is formed before the voltage application starting.

10. An image forming apparatus according to claim 9, wherein the time when the electric field is formed is always the same, regardless of the recording material type.

11. An image forming apparatus according to claim 2, wherein time between the voltage application starting and the arrival of the leading end of the recording material at the nip is controlled in response to at least one of the size, thickness, and resistance of the recording material.

12. An image forming apparatus according to claim 1, wherein said transferring member is a rotary member.

13. An image forming apparatus according to one of claims 1, 2, 3, 8, 9, 10 and 12, wherein said transferring member is disposed in contact with said image bearing member.

14. An image forming apparatus comprising:

an image bearing member for bearing a toner image; and a transferring member for forming a nip in cooperation with said image bearing member and for transferring the toner image from said image bearing member to a sheet of recording material, in the nip, wherein a voltage having a polarity opposite to the normal toner charge polarity is applied to said transferring member to transfer the toner image to the recording material;

a plurality of recording material feeding means for feeding the recording material to the nip, and time between voltage application starting and arrival of the leading end of the recording material at the nip is controlled in response to selected feeding means among said plurality of the feeding means.

15. An image forming apparatus according to claim 14, wherein time when the voltage application to said transferring member begins is before the arrival of the leading end of the recording material at the nip, regardless of the type of the selected feeding means among said plurality of feeding means.

16. An image forming apparatus according to claims 14 or 15, wherein said transferring member is a rotary member, and when the recording material is fed through the manual feeding means, the time between the voltage application starting and the arrival of the leading end of the recording material at the nip is equivalent to at least one full turn of the said transferring member.

17. An image forming apparatus according to claim 15, wherein the special type of sheet fed through the manual feeding means is a post card.

18. An image forming apparatus according to claim 15, wherein a special type of sheet fed through the manual feeding means is a sheet of transparent resin material.

19. An image forming apparatus according to claim 14, wherein the plurality of feeding means including a manual feeding means and a cassette based feeding means, and when the recording material is fed through the manual feeding means, time between the voltage application starting and the arrival of the leading end of the recording material at the nip is longer than when the recording material is fed through the cassette feeding means.

20. An image forming apparatus according to claim 19, wherein when the recording material is fed through the cassette feeding means, the time between the voltage application starting and the arrival of the leading end of the recording material at the nip is shorter than one full turn of said transferring member.

21. An image forming apparatus according to claim 14, wherein said transferring member is a rotary member, and the time between the voltage application starting and the arrival of the leading end of the recording material at the nip is rendered either equivalent to at least one full turn of the said transferring member or shorter than on full turn of said transferring member in response to the selected feeding means among the plurality of feeding means.

22. An image forming apparatus according to claim 21, wherein time when the electric field is formed is always the same, regardless of the type of the selected feeding means among the plurality of the feeding means.

23. An image forming apparatus according to claim 14, wherein an electric field, which functions to transfer the toner having the same charge polarity as the toner image from said transferring member to image bearing member, is formed before the voltage application starting.

24. An image forming apparatus according to claim 14, wherein said transferring member is a rotary member.

25. An image forming apparatus according to one of claims 14 and 22 wherein said transferring member is disposed in contact with said image bearing member.

* * * * *

UNITED STATES PATENT AND TRADEMARK OFFICE

CERTIFICATE OF CORRECTION

PATENT NO. : 5,504,565

DATED : April 2, 1996

INVENTOR(S) : SATOSHI TOMIKI, et al.

It is certified that error appears in the above-indentified patent and that said Letters Patent is hereby corrected as shown below:

ON THE COVER PAGE

[57] ABSTRACT

Line 8, "the between" should read --time between--.

COLUMN 1

Line 9, "comprises" should read --comprise--.

COLUMN 2

Line 39, "is" should be deleted.

COLUMN 4

Line 25, "drum i" should read --drum 1--.

COLUMN 5

Line 54, "roller 20," should read --rollers 20,--.

COLUMN 8

Line 20, "different size" should read --different sizes--.
Line 53, "on" should read --one--.

COLUMN 10

Line 40, "to" should read --to said--.

UNITED STATES PATENT AND TRADEMARK OFFICE

CERTIFICATE OF CORRECTION

PATENT NO. : 5,504,565 Page 2 of 2

DATED : April 2, 1996

INVENTOR(S) : SATOSHI TOMIKI, et al.

It is certified that error appears in the above-indentified patent and that said Letters Patent is hereby corrected as shown below:

COLUMN 12

Line 12, "on" should read --one--.
Line 22, "to" should read --to said--.
Line 28, "14 and 22" should read
--14, 15, 19 and 20-23,--.

Signed and Sealed this

Tenth Day of September, 1996

Bruce Lehman

*Attest:*

BRUCE LEHMAN

*Attesting Officer*

*Commissioner of Patents and Trademarks*